US005405039A

United States Patent [19]

Komura

[11] Patent Number: 5,405,039

[45] Date of Patent: Apr. 11, 1995

[54] CAN FOR BEVERAGE

[75] Inventor: Masahiro Komura, Tokyo, Japan

[73] Assignee: Komura & Co., Ltd., Tokyo, Japan

[21] Appl. No.: 135,163

[22] Filed: Oct. 12, 1993

[30] Foreign Application Priority Data

Oct. 9, 1992 [JP] Japan ..... 4-076853

[51] Int. Cl.[6] ..... B65D 17/34

[52] U.S. Cl. ..... 220/269; 220/270

[58] Field of Search ..... 220/266, 267, 268, 269, 220/270, 271, 272, 273, 276

[56] References Cited

U.S. PATENT DOCUMENTS 4,258,859 3/1981 Westphal ..... 220/270
4,564,119 1/1986 Tsuge et al. ..... 220/270
4,913,305 4/1990 Hanafusa et al. ..... 220/269

FOREIGN PATENT DOCUMENTS 58-17331 2/1983 Japan .
62-26350 7/1987 Japan .

*Primary Examiner*—Allan N. Shoap
*Assistant Examiner*—Nova Stucker
*Attorney, Agent, or Firm*—Wenderoth, Lind & Ponack

[57] ABSTRACT

A can for containing a beverage has a cylindrical body, a top lid for forming an opening through which the beverage can be drunk from the can, a small tab having a finger-receiving hole staked to a central portion of the top lid with a staking member, and a line of weakness defining the opening. This line is in the form of a segment of a circle centered about the staking member. This segment is between an approximately semicircular segment and a 90 degree segment.

3 Claims, 3 Drawing Sheets

CAN FOR BEVERAGE

BACKGROUND OF THE INVENTION

1. Field of the Invention

This invention relates to a can and in particular, a can for containing a beverage such as beer or a carbonated beverage, that is sold by an automatic vending machine.

2. Prior Art

A conventional can filled with beer or a variety of other beverages such as a carbonated beverage, is shown in FIG. 5.

This can 20 includes an opening 21 in its top for use in drinking the beer or other beverage from the can. A small tab 24 having a finger-receiving hole 23 is staked to the central portion of the top lid 22 of the can 20 with a staking member 25. A line of weakness 26 for forming the opening is in itself formed, by means such as a press, about the staking member 25 in a portion of the lid.

With the can 20 as shown in FIG. 5, when one's finger is placed in the hole 23 in the small tab 24 and the small tab 24 is pulled upward, the area surrounded by the line 26 in the top surface 22 is depressed into the can 20 by the end portion 27 of the small tab 24 with the staking member 25 acting as the fulcrum, resulting in the area of the lid 22 surrounded by the line 26 being separated from the remainder of the lid 22 with an opening being produced at such area. The small tab 23 that is pulled upward may be returned to the original position after the opening is produced.

The opening allows one to drink the beer or other beverage from the can 20.

This conventional type of can shown in FIG. 5 is distinct from the so-called pull-top can, which is configured so that the entire area surrounded by the line of weakness is to be removed from the can itself by means of a small tab (pull-top) so that the small tab itself is separated from the top lid of the can.

Although the conventional can as described above is extremely convenient for carrying since it eliminates the need for using a cup or other vessel, the portion which is surrounded by the line of weakness 26 and is separated from the top surface of the lid 22 is extremely narrow and small. Therefore, only small increments of the beverage can be drunk from the can at a time.

Consequently, it has conventionally been impossible to drink a beverage from a can with the same natural feel as that which can be had when drinking a beverage poured from a cup. Especially when the beverage in a can is beer, the flavor inherent to beer cannot be tasted because, with the conventional can, the opening is extremely narrow and small, and thus the beer can be drunk only in small increments, although it is perceived that beer itself is more delicious when drunk in gulps. Therefore, it is no exaggeration to say that the situation as stated above generally results in the consumption of canned beer to be low compared to that of bottled beer.

SUMMARY OF THE INVENTION

An object of the present invention is to overcome the above-described drawback of the prior art by providing a can which, by itself, allows a beverage to be drunk with the same natural feel as that which can be had when drinking a beverage from a cup, and which, especially when the beverage contained in the can is beer, allows it to be drunk in gulps, whereby the full flavor of the beer can be perceived.

The can of the present invention has a cylindrical body, a top lid in which an opening for use in drinking the beer or other beverage from the can is defined, a small tab having a lifting portion defining a finger-receiving hole and a pressing portion staked to the central portion of the top lid by a staking member, and a line of weakness for forming the opening. This line extends, at the outer periphery of the lid, along a circle centered at the staking member and extends over an angular range between an approximately semicircle to approximately 90 degrees or wider about the staking member on the top lid.

DETAILED DESCRIPTION OF THE PREFERRED EMBODIMENTS

Preferred embodiments of the can for containing a beverage according to the present invention will now be described by referring to the accompanying drawings.

Figure 1:
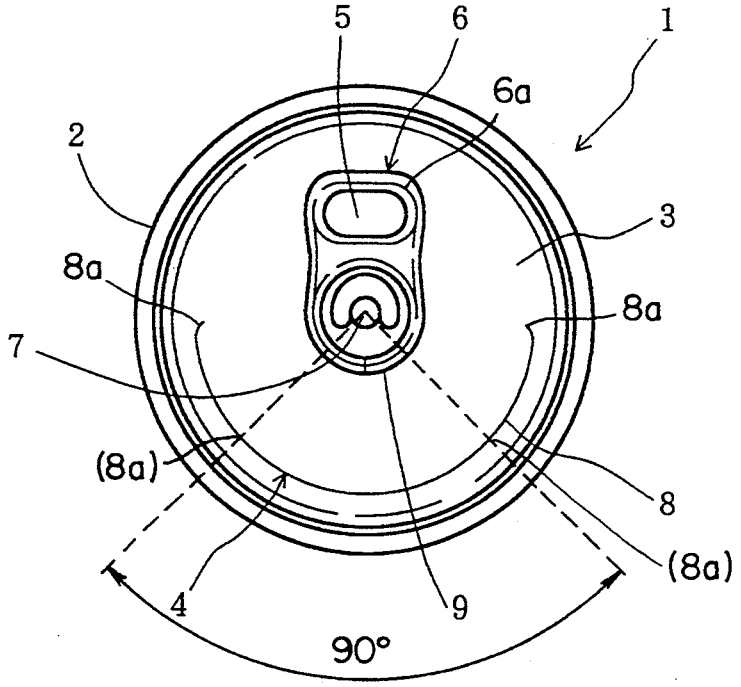
FIG. 1 is a plan view of an embodiment of a can according to the present invention.
Figure 2:
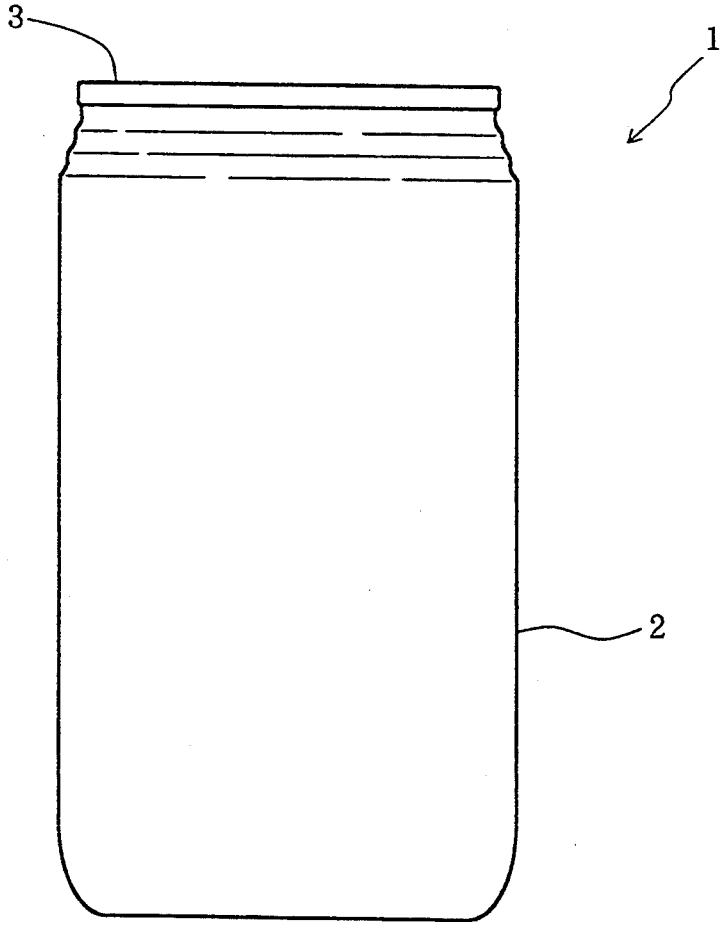
FIG. 2 is a side view of the can.

First, referring to FIG. 1, the can comprises a cylindrical body 2 whose upper and lower ends are hermetically sealed. A top lid 3 seals one of the ends of the body and is provided with an opening 4 for use in drinking the beer or other beverage directly from the can 1.

A small tab 6 has a lifting portion **6*a* defining a finger-receiving hole 5 and a pressing portion 6*a* and is staked to the central portion of the top lid 3 of the can 1 with a staking member 7. The pressing portion 6*a* is located on an opposite side of the staking member 7 from the lifting portion, whereby staking member 7 serves as a fulcrum. A line of weakness 8 is formed in the outer periphery of the lid 3 with the pressing portion 6*a* of the said small tab 6 located between line 8 and the staking member 7. The line extends over approximately half of the top lid 3, i.e. in a semicircle so as to end at the outer periphery of the lid 3 at points 8*a*, 8*a***. The line is formed by a press or other known means.

In the embodiment shown in FIG. 1, the line of weakness 8 is shown as extending approximately in a semicircle centered about the staking member 7. However, the range over which the line 8 extends is not so limited. Rather, the semicircle is the maximum range, and the line of weakness 8 may be in the form of a segment of a circle which is smaller than the semicircle to some degree. For example, the line may extend over an angular range encompassing an approximately semicircle to an approximately one-fourth or more (designated by the dashed lines in FIG. 1) of the outer periphery of the can 1, i.e. lines passing through each of the points **8*a*, 8*a* and the staking member 7 along the top lid 3** subtend an angle within a range of approximately 90° and 180°.

Figure 3:
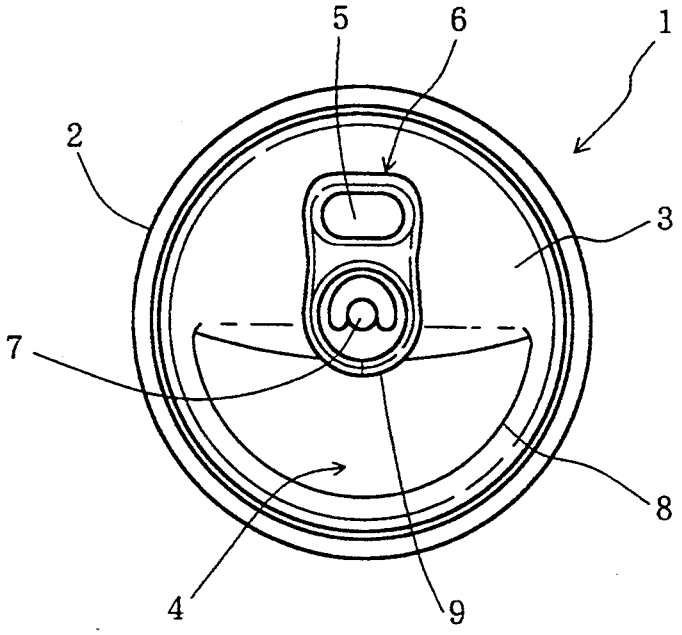
FIG. 3 shows the opened state of the can.
Figure 4:
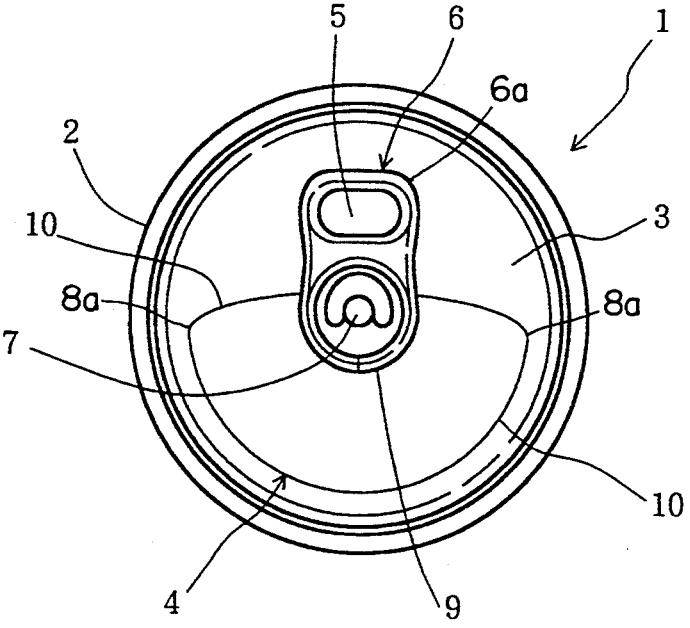
FIG. 4 is a plan view of another embodiment of a can according to the present invention.
Figure 5:
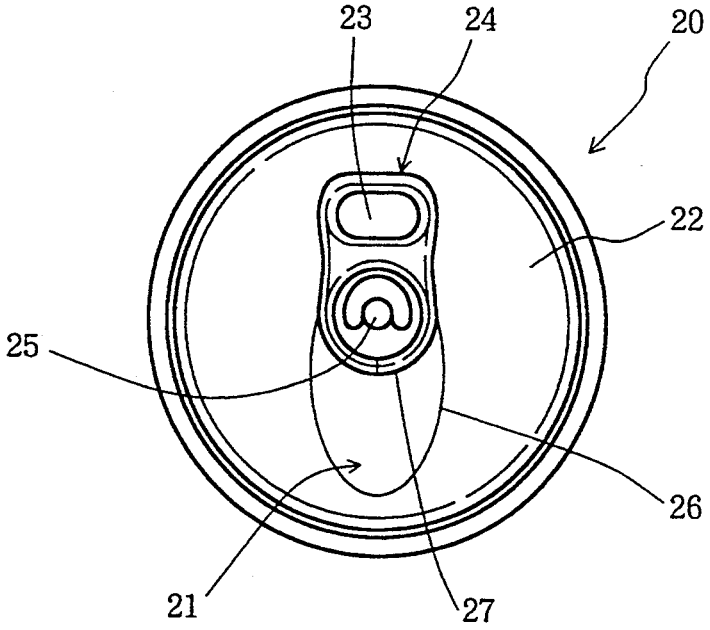
F I G. 5 PRIOR ART
FIG. 5 is a plan view of a conventional can.

As shown in FIG. 3, the embodiment of FIG. 1 is configured so that, even after the can 1 is opened, the small tab 6 and the portion of the top lid 3 that is surrounded by the line of weakness 8 are not separated from the top surface 3 of the can 1. However, this invention is not limited to the above configuration. As shown in FIG. 4, a line of weakness 10 defining opening 4 may include another portion extending from point **8*a*** to point 8*a* between the staking member 7 which stakes the small tab 6 to the lid 3 and lifting portion 6*a* so that when the can 1 is opened, the entire area of the lid 3 surrounded by the line 10 along with tab 6 and is separated from the remainder of the top lid 3.

The can 1 of the present invention may be made of any material such as aluminum or steel.

The opening of the can of the present invention will now be described by referring to FIGS. 1 and 3.

When a finger is slipped into the hole 5 in the small tab 6 in the can 1 as shown in FIG. 1 and the small tab 6 is pulled upward, the entire area surrounded by the line 8 in the top lid 3 is depressed into the can 1 by the pressing portion 9 of the small tab 6 with the staking portion 7 acting as the fulcrum. Accordingly, the area surrounded by the line 8 is separated from the remainder of the top lie 3 with an opening being produced in as shown in FIG. 3.

The lifting portion 6*a* of the said small tab 6 defining hole 5 may be returned to its original position after the opening in the can is produced.

In the embodiment shown in FIG. 4, a finger is slipped into the hole 5 in the small tab 6 in the can 1 and the small tab 6 is pulled upward. Simultaneously with the opening of the can 1, the entire area surrounded by the line 10 in the top lid 3 of the can 1 is removed from the remainder of the top lid 3 together with the small tab 6.

Then, the beer or other beverage contained in the can 1 can be drunk through the large opening formed in the lid 3.

That is, a wide area surrounded by the lines 8 or 10 in the top lid 3 of the can 1 is opened. Therefore, a beverage can be drunk directly from the can with the same natural feel as that which can be had when drinking a beverage from a cup. Especially when the beverage is beer, the can allows it to be drunk in gulps as if the beer were in a cup. Accordingly, the full flavor of the beer can be sensed.

The present invention is not limited to the above-described embodiments, and is intended to encompass several variations within the scope of the appended claims.

What is claimed:

1. A can comprising: a cylindrical body; an upper lid hermetically sealed to said cylindrical body at one end thereof so as close said end; a tab having a lifting portion defining a hole therein sized to receive one's finger; a staking member staking said tab to a central portion of said lid; said tab also having a pressing portion on an opposite side of said staking member from said lifting portion and said lid having only one line of weakness, said line of weakness extending in the outer periphery of the lid along a circle centered at said staking member, said line of weakness ending at the outer periphery of the lid at two points, lines extending from each of said points to said staking member subtending an angle within a range of approximately 90° and 180° on a side of the lid at which said pressing portion is disposed, and said pressing portion being located between said line of weakness and said staking member, whereby said line of weakness is broken by a downward force exerted on the lid by said pressing portion of the tab when said lifting portion of the tab is lifted to form an opening in the lid in the shape of a segment of a circle, said segment being of a size between that of approximately a semicircle and approximately a 90° segment of a circle.

2. A can as claimed in claim 1, wherein the can is an aluminum can.

3. A can as claimed in claim 1, wherein the can is a steel can.

* * * * *